US006387194B1

(12) United States Patent
Zeigler et al.

(10) Patent No.: US 6,387,194 B1
(45) Date of Patent: May 14, 2002

(54) PROCESS AND COMPOSITION FOR CHROMIZING 400-SERIES STAINLESS STEELS

(75) Inventors: Douglas D. Zeigler, Atwater; James M. Tanzosh, Silver Lake; George H. Harth, Wadsworth; Walter R. Mohn, North Canton, all of OH (US)

(73) Assignees: McDermott Technology, Inc; The Babock & Wilcox, both of New Orleans, LA (US)

( * ) Notice: Subject to any disclaimer, the term of this patent is extended or adjusted under 35 U.S.C. 154(b) by 0 days.

(21) Appl. No.: 09/788,742

(22) Filed: Feb. 20, 2001

(51) Int. Cl.[7] ..... C23C 18/31
(52) U.S. Cl. ..... 148/530; 148/537; 427/253
(58) Field of Search ..... 148/530, 537; 427/253

(56) References Cited

U.S. PATENT DOCUMENTS 4,904,501 A * 2/1990 Davis ..... 427/253
5,041,309 A 8/1991 Davis et al.
5,135,777 A 8/1992 Davis et al.
5,492,727 A * 2/1996 Rapp et al. ..... 427/253
5,912,050 A 6/1999 Zeigler et al.
5,972,429 A * 10/1999 Bayer et al. ..... 427/253

* cited by examiner

*Primary Examiner*—George Wyszomierski
(74) *Attorney, Agent, or Firm*—Robert C. Baraona

(57) ABSTRACT

An improved process for chromizing and chrome-siliconizing 400-series stainless steel components, and in particular, 430 stainless steel components, such as boiler panel studs. The process includes the addition of between 0.12%–0.25% by weight of calcium fluoride salt to the conventional 4% by weight of ammonium chloride activator salt to the coating composition used in known diffusion coating processes. In a more preferred embodiment, small amounts of silicon powder, such as between about 0.12%–0.25% by weight, are added to the two salts and the diffusion coating material. A coating composition is provided as well.

9 Claims, No Drawings

PROCESS AND COMPOSITION FOR CHROMIZING 400-SERIES STAINLESS STEELS

FIELD AND BACKGROUND OF THE INVENTION

The present invention relates generally to the field of applying surface diffusion coatings to industrial parts and in particular to a new and useful composition and process for applying uniformly thick diffusion coatings on 400-series stainless steel components.

Chromizing is a process of producing a chromium diffusion coating on ferrous-base components to improve corrosion resistance, especially at elevated temperatures. Chromizing was developed to produce an integral protective surface coating on components exposed to extreme conditions for the purpose of enhancing their usable life. One common application of chromized parts is in power generation, such as for boiler waterwall panels and studs.

Many different processes for chromizing components with surface diffusion coatings of chromium and chromium-silicon have been developed, patented and commercialized successfully.

U.S. Pat. Nos. 5,135,501 and 5,041,309, for example, teach a "blanket" process in which an inert refractory container is coated with a slurry of a diffusion composition. The composition may contain chromium as the diffusion element. The container is then inserted within or placed on a workpiece that will be coated with the diffusion coating, and heat treated to cause the diffusion to take place. The container is then removed to leave the chromized workpiece. Commonly, a spun alumnia-silica fiber paper or blanket is used as the inert container.

U.S. Pat. No. 5,912,050 discloses a process for chromizing many small parts in layers within a retort. The parts are placed within the retort on a sheet of refractory felt paper, covered with a diffusion coating slurry that is allowed to dry prior to heating of the retort, while additional layers of felt paper, parts and slurry are added to the retort. The retort is sealed and heated, causing the diffusion coating to adhere to the parts covered in the slurry.

The disclosures of U.S. Pat. Nos. 4,904,501 and 5,135,777 and 5,041,309 and 5,912,050 are hereby incorporated in their entirety for their discussions of different diffusion coating processes.

Chromizing and chrome-siliconizing processes have been shown to work well on many different types of steels, including T2, T22, T23, 1010, 1018, T11, 178A, T91, 304 stainless steel, 309H stainless steel and 347H stainless steel.

However, 400-series stainless steels have been notoriously difficult to apply diffusion coatings to in useful thicknesses and continuities. Conventional diffusion methods typically result in porous chromium diffusions of only 1–2 mils thick and having many discontinuities in the coating on 400-series stainless steels. These problems are especially evident with 430 stainless steel components.

Diffusion coatings that are so thin and porous with discontinuities are effectively useless for their intended purpose of protecting the coated component.

SUMMARY OF THE INVENTION

It is an object of the present invention to overcome the difficulties associated with prior diffusion coating processes applied to 400-series stainless steels.

It is a further object of the invention to provide a method for applying a uniform, relatively thick diffusion coating of chromium or chromium-silicon to 400-series stainless steel components.

Accordingly, a diffusion coating process for chromizing or chrome-siliconizing a 400-series stainless steel component includes the steps of mixing a small quantity of calcium fluoride with the chromium or chromium-silicon coating element and ammonium chloride activator salt prior to using one of the prior known processes for applying the diffusion coating. The improved diffusion coating mixture may be applied using the blanket method or that of U.S. Pat. No. 5,912,050 or other known diffusion coating methods.

In a further embodiment, small amounts of silicon powder are also added to the coating mixture.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENTS

The invention provides a new method of producing chromized stainless steel components by applying a chromium or chromium-silicon (Cr—Si) diffusion coating material in combination with calcium fluoride (CaF) and ammonium chloride ($NH_4Cl$) activator using conventional diffusion coating processes, such as those taught by U.S. Pat. Nos. 5,135,501 and 5,041,309 and 5,912,050. That is, the diffusion coating can be formed at least by either the blanket method or the layered slurry coating method. Other known diffusion methods used to apply chromium and chromium-silicon coatings can also be adapted to use the compositions of the invention and form the coatings on 400-series stainless steel.

The invention establishes an improved process for chromizing and chrome-siliconizing 400-series stainless steel components, and in particular, 430 stainless steel components, such as boiler panel studs. The process requires the addition of about 0.25% by weight of calcium fluoride salt to the conventional 4% by weight of ammonium chloride activator salt and coating material used in the coating compositions of the diffusion coating processes. In a more preferred embodiment, small amounts of silicon powder, such as about 0.25% by weight, are added to the two salts and the diffusion coating material as well.

EXAMPLE 1

In one test of the new diffusion coating composition, about 0.25% by weight of calcium fluoride was added to 4% by weight of ammonium chloride and combined with the remainder of chromium to form a diffusion composition.

The diffusion composition of the invention was applied to 430 stainless steel using the blanket diffusion coating process. The diffusion coating produced was uniformly thick, non-porous and fully dense. The coating was found to be about 14–15 mils thick.

EXAMPLE 2

In a second test, a small scale chromizing process was done using samples of both 430 stainless steel and 1010 carbon steel studs. The blanket chromizing process was used to coat the studs. The diffusion coating composition used comprised 4% wt. ammonium chloride, 0.25% wt. calcium fluoride, 0.25% wt. silicon powder and the remainder was chromium. After the diffusion process was complete, samples of each type of stud were evaluated. The 430 stainless steel studs showed 98% concentration of chromium at the surface, with a logarithmic decrease to about 18% at the base of the coating through a coating depth of 35 mils. Optical inspection revealed that the 430 stainless steel stud coating depth was about 10–12 mils, although a chromium concentration in excess of 18% (the typical concentration of chromium in stainless steel) extended to about 35 mils. The 1010 carbon steel stud had a coating depth of 6–8 mils.

The results of the tests conducted using the improved diffusion coating composition revealed that the calcium fluoride appears to disrupt the passivating surface layer found on 430 stainless steels and other 400-series stainless steels. The disruption permits the chromium diffusion coating layer to form on the stainless steel parts where the passivating surface, which is not found on other types of steel, would otherwise prevent the formation.

In alternative coating compositions, other fluoride compounds such as silicon tetrafluoride ($SiF_4$) and hydrogen fluoride (HF) could be substituted for the calcium chloride and used in the same amounts. Further, the amounts of fluoride compounds and silicon powder used could be reduced to about 0.12% by weight, and possibly increased to about 0.5% by weight.

The more fluoride compound and silicon powder used results in increasing porosity in the chromized components.

While a specific embodiment of the invention has been shown and described in detail to illustrate the application of the principles of the invention, it will be understood that the invention may be embodied otherwise without departing from such principles.

We claim:

1. A method of producing a stainless steel product having a protective coating comprising:

combining about 0.12%–0.5% wt. of a fluoride compound, 4% wt. of ammonium chloride and the remainder one of chromium and chromium-silicon to form a diffusion coating composition;

providing at least one stainless steel component;

forming a diffusion coating on the at least one stainless steel component using the diffusion coating composition.

2. A method according to claim 1, wherein the at least one stainless steel component is made of 400-series stainless steel.

3. A method according to claim 2, wherein the fluoride compound comprises one of calcium fluoride, hydrogen fluoride and silicon fluoride.

4. A method according to claim 3, wherein the combining comprises mixing about 0.12%–0.25% wt. of one of calcium fluoride, hydrogen fluoride and silicon fluoride, 4% wt. of a ammonium chloride and the remainder one of chromium and chromium-silicon.

5. A method according to claim 3, wherein the fluoride compound is calcium fluoride.

6. A method according to claim 1, wherein the fluoride compound comprises one of calcium fluoride, hydrogen fluoride and silicon fluoride.

7. A method according to claim 1, wherein forming a diffusion coating comprises performing a blanket diffusion coating process.

8. A method according to claim 1, wherein forming a diffusion coating comprises performing a layered component slurry coating diffusion coating process.

9. A method according to claim 1, wherein forming the diffusion coating further comprises forming a diffusion coating having an optical inspection depth of at least 8 mils.

* * * * *

UNITED STATES PATENT AND TRADEMARK OFFICE

CERTIFICATE OF CORRECTION

PATENT NO. : 6,387,194 B1 
DATED : May 14, 2002
INVENTOR(S) : Douglas D. Zeigler, James M. Tanzosh, George H. Harth and Walter R. Mohn It is certified that error appears in the above-identified patent and that said Letters Patent is hereby corrected as shown below:

Title page,
Item [73], should read -- Assignees: McDermott Technology, Inc.; The Babcock & Wilcox Company, both of New Orleans, LA (US) --

Signed and Sealed this

Fifteenth Day of October, 2002

*Attest:*

*Attesting Officer*

JAMES E. ROGAN
*Director of the United States Patent and Trademark Office*